US006752243B1

(12) United States Patent
Terzini

(10) Patent No.: US 6,752,243 B1
(45) Date of Patent: Jun. 22, 2004

(54) LOCKING AND REMOVABLE STEP

(76) Inventor: Robert Terzini, 138 E. Clinton Dr., Rome, GA (US) 30165

( * ) Notice: Subject to any disclaimer, the term of this patent is extended or adjusted under 35 U.S.C. 154(b) by 0 days.

(21) Appl. No.: 10/226,983

(22) Filed: Aug. 23, 2002

Related U.S. Application Data

(63) Continuation-in-part of application No. 09/667,875, filed on Sep. 22, 2000, now abandoned, and a continuation-in-part of application No. 09/780,886, filed on Feb. 9, 2001.

(51) Int. Cl.[7] ..... E04G 3/00

(52) U.S. Cl. ..... 182/92; 182/134; 182/187; 182/189; 248/246

(58) Field of Search ..... 182/90, 92, 133–136, 182/187–189, 100, 221; 248/216.1, 246

(56) References Cited

U.S. PATENT DOCUMENTS

| | | | | |
|---|---|---|---|---|
| 623,517 A | | 4/1899 | Carpenter | |
| 1,482,745 A | | 2/1924 | Heid | |
| 1,597,095 A | | 8/1926 | Martinson | |
| 1,613,716 A | | 1/1927 | Mylaeus | |
| 3,561,563 A | | 2/1971 | Harsh | |
| 3,610,368 A | * | 10/1971 | Johnson | 182/146 |
| 3,684,058 A | * | 8/1972 | Brown | 182/132 |
| 4,696,372 A | | 9/1987 | Fields | |
| 4,753,447 A | | 6/1988 | Hall | |
| 4,754,841 A | | 7/1988 | Koffski | |
| 5,285,868 A | | 2/1994 | Amacker | |
| 5,417,306 A | | 5/1995 | Robl | |
| 5,564,248 A | | 10/1996 | Callies | |
| 5,620,059 A | | 4/1997 | Crispeno | |
| 5,845,743 A | | 12/1998 | Dechant | |
| 6,003,630 A | * | 12/1999 | Whalen | 182/82 |
| 2002/0139614 A1 | * | 10/2002 | Volkman | 182/82 |
| 2003/0010569 A1 | * | 1/2003 | Wyse | 182/118 |

FOREIGN PATENT DOCUMENTS

| | | | | |
|---|---|---|---|---|
| JP | 46951 | * | 2/2002 | 182/92 X |

* cited by examiner

*Primary Examiner*—Bruce A. Lev
(74) *Attorney, Agent, or Firm*—Kilpatrick Stockton LLP

(57) ABSTRACT

An easy to use device that attaches to a beam for use as a step and allowing a user to stand on and attain elevation. A plank can be used in combination with the tool to form a shelf, scaffold or platform. The upper surface of the tool comprises tapered ribs located on the back edge of the upper surface. A vertical member and collar are attached to the tool. When the tool is placed on a beam and downward force is applied to the tool, the ribs engage a first side of the beam and the collar engages the opposite side of the beam, forming a lever. The user is free to stand on the tool for support and elevation.

11 Claims, 13 Drawing Sheets

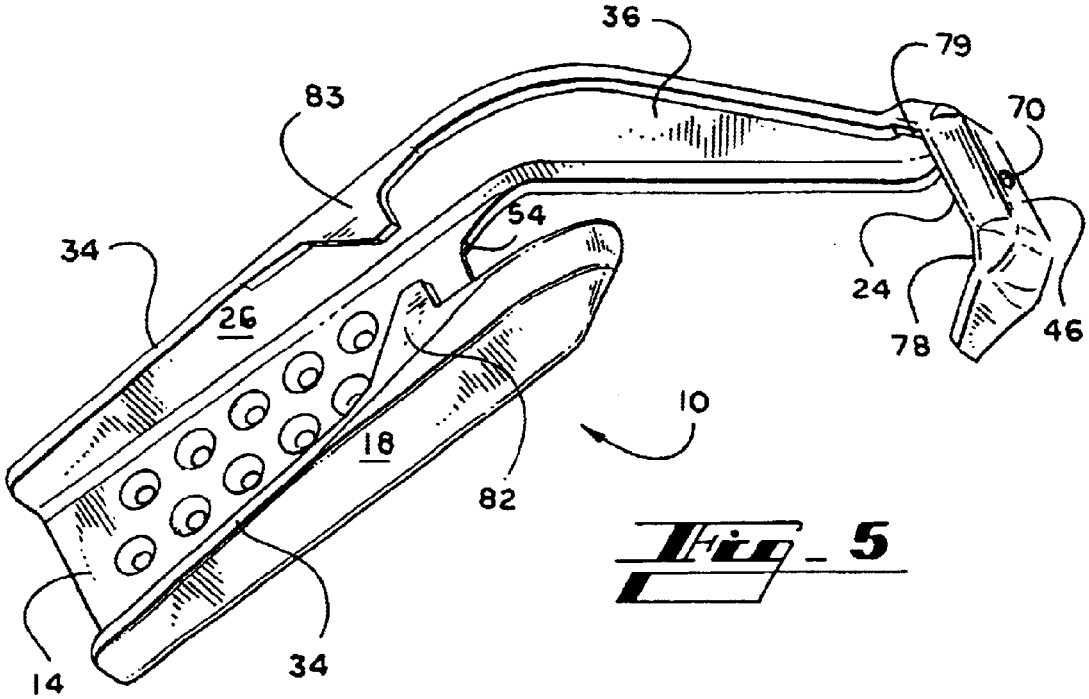
Fig_5
Fig_6
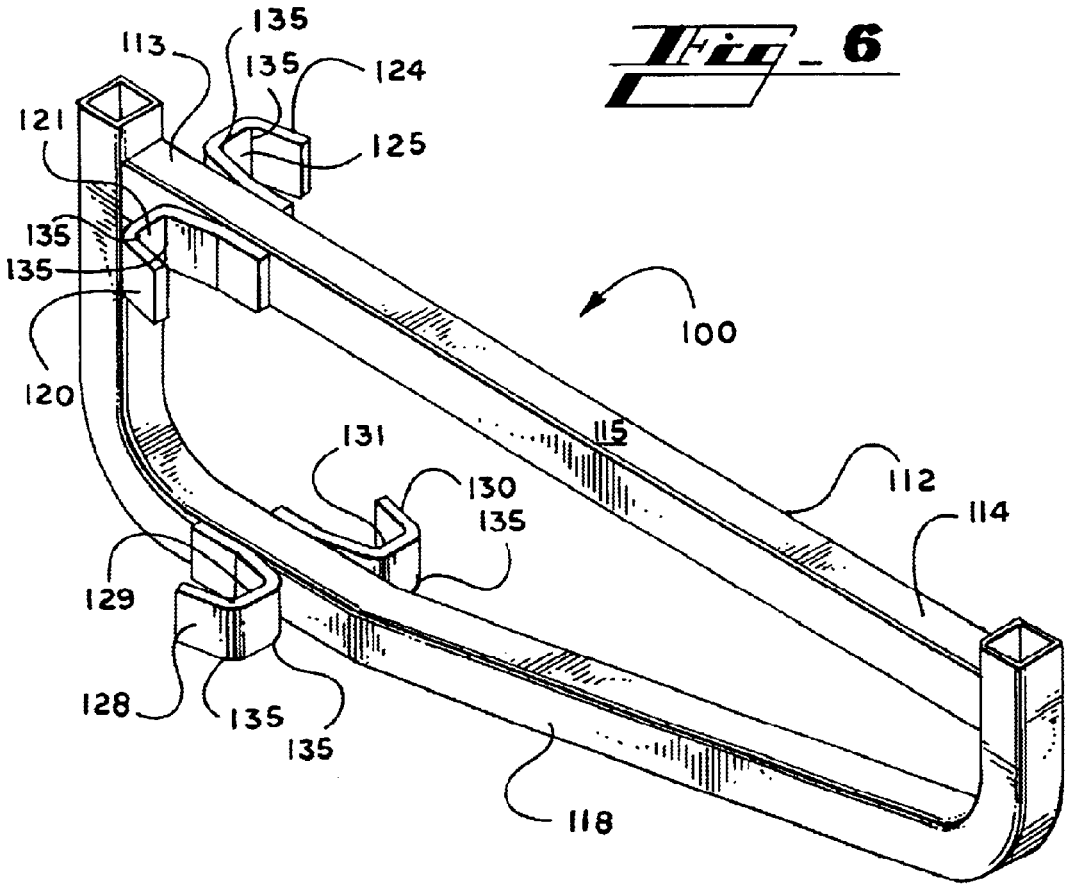

144
150
144
144
144
100
150

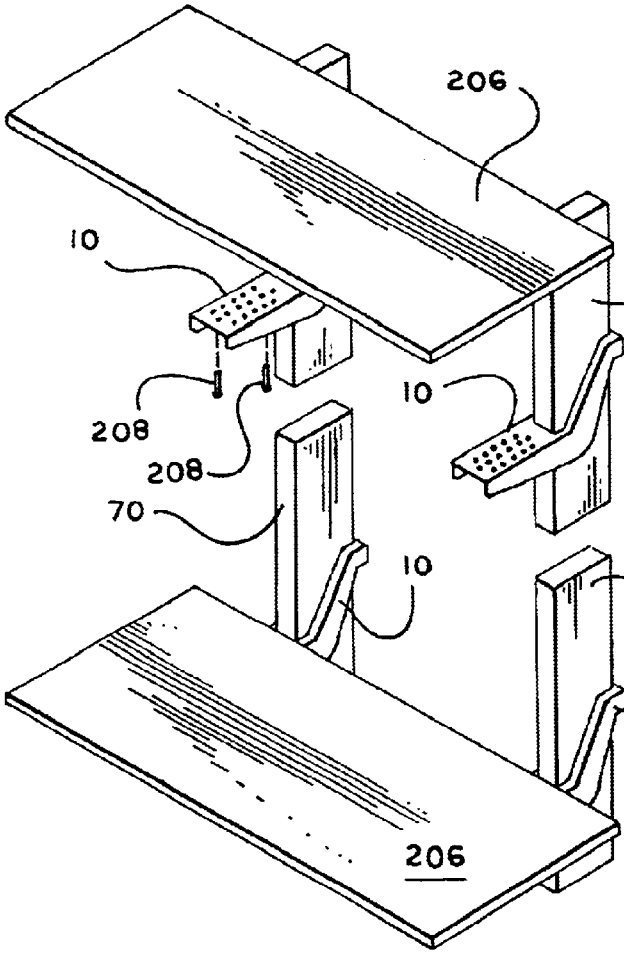
Fig_20
Fig_21
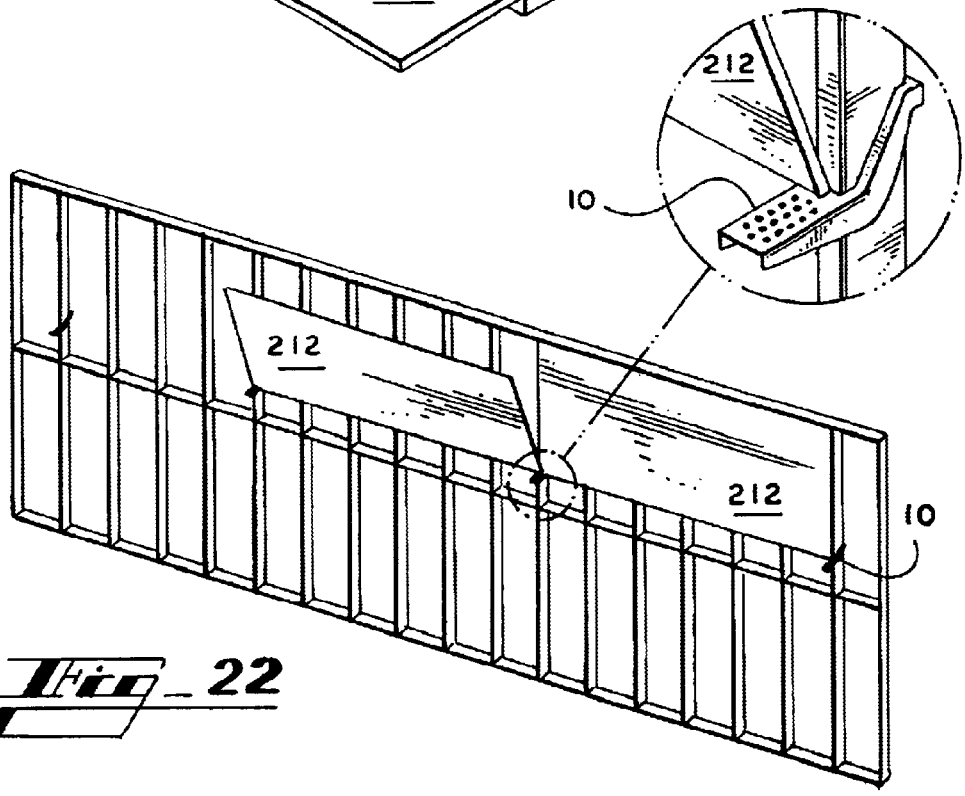
Fig_22

LOCKING AND REMOVABLE STEP

RELATED APPLICATIONS

This application is a continuation in part of U.S. application Ser. No. 09/667,875 Sep. 22, 2000 now abandoned and U.S. application Ser. No. 09/780,886 Feb. 9, 2001.

FIELD OF THE INVENTION

This invention relates in general to lightweight tools, and more particularly relates to a lightweight tool for supporting a person or other items above ground level.

BACKGROUND OF THE INVENTION

It is common in residential and commercial building construction for the structure being built to be "studded" prior to performing carpentry, electrical, plumbing, HVAC installation, and other trade installation, typically in the wall and ceiling area. This entails defining each room in the structure by vertically oriented wooden beams, or studs, that indicate the location of the walls of the structure, both interior and exterior. The wooden beams, or construction beams are typically 2 in. by 4 in., but other sizes may be used.

Often during residential and commercial construction, a construction worker will need to access the overhead area of wall and ceiling portion of a studded room. For example, there may be a need to manipulate electrical wiring or fixtures of any configuration located in or on the walls and ceilings. Typical wall and ceiling areas above 6 feet are too high for a worker to reach while standing on the floor. The worker must use a ladder or some other device such as a chair or paint can to gain the elevation and support needed to access the wall and ceiling area and complete the task. It is often time consuming and cumbersome to locate and transport a ladder to the appropriate location. Chairs and paint cans may not provide the required stability or support for the worker and may also be difficult to locate.

Some prior art step tools require the user to slide the tool over the end of a beam. This is very cumbersome and prevents the user from using the tool with a fixed beam, an application that is very applicable for a step tool. Other prior art step tools require the user to use both hands to affix the tool.

Many tasks needed to be performed during construction are very difficult to perform alone. This is due to a variety of factors including the bulky nature of certain construction materials and the need to temporarily support or suspend an item while performing another action.

It is also common in finished construction to have a portion of the space left unfinished. This typically results in a framed area with wooden beams or studs defining certain boundaries within the unfinished space. However, there is no dry wall or other similar material placed between the exposed wooden beams. These types of unfinished areas are often used for storage, for example in the basement of a residential home. Many people expend significant resources purchasing shelving units in order to more efficiently use this space. These units may go unwanted after the particular area is finished.

Accordingly, there is a need in the art for a lightweight tool that is easily portable, simple in construction, and can support a person seeking to gain some elevation and support above the floor.

There is also a need for a tool that is inexpensive and can be used to provide a storage surface in unfinished construction areas in commercial spaces and residential homes. There is also a need for a tool that assists individuals in performing construction related tasks alone.

SUMMARY OF THE INVENTION

The present invention seeks to provide a lightweight, portable tool that can attach to a beam, such as that found in an unfinished construction area, and support the weight of and provide needed elevation for a user.

The invention accomplishes these objects by providing a tool including an upper surface and side walls. Ribs located along the rear edge of the upper surface, at the corners where the rear edge meets the side walls, engage a first side of a beam which is preferably wooden. A vertical member extends upward from one of the side walls. A collar is attached to the vertical member to engage the opposite side of the beam. Ribs located along the top and bottom edges of the collar grip the opposite side of the beam. The user then can apply a downward force to the upper surface which forces the ribs to grip the beam, stabilizing the tool. The user is then free to stand on the tool which supports the user and provides the needed elevation.

Generally described, the present invention provides a tool that can be used to support a weight above the floor. The tool, used for engaging a beam typical of that used in construction, comprises an upper surface and first ribs extending from a rear edge of the upper surface. The ribs engage and grip a first side of the beam. A vertical member extends from a first side of the rear edge of the upper surface. A collar attached to the vertical member engages the opposite side of the beam.

The present invention provides an easy to use tool that can be slipped around a substantially vertical fixed beam or support using a single hand. As downward force is applied to the upper surface of the tool, the ribs of the tool engage and grip all four sides of the beam, stabilizing the tool. The user is then free to use the tool for support by stepping on the upper surface of the tool.

The present invention is used to support a weight by placing the tool at an appropriate height, that equates to the desired elevation, along a substantially vertical fixed beam. The tool comprises a upper surface and first ribs extending from a rear edge of the upper surface. A vertical member extends from a first side of the rear edge of the upper surface. A collar attached to the vertical member engages the opposite side of the beam. The tool is light weight and can be placed on a structural beam used in construction using only one hand. When placed on the beam, the tool engages all four sides of the beam. Downward force applied to the tool causes the first ribs to grip a first side of the beam and the collar to engage the opposite side of the beam. The user may step on the upper surface of the tool in order to achieve the needed elevation. Protrusions are provided on the upper surface in order to increase friction between the users shoe sole and the upper surface and prevent slipping.

The present invention can also be produced in various sizes. Two tools of the present invention can be used on adjacent beams in an unfinished area to form a support shelf. Each tool is placed on a beam at the same height. Downward force is applied to the upper surface of each tool to stabilize the tools. This allows the ribs of each tool to engage and grip the beam. A board or plank may then be placed so that it is supported on either end by the tools. This creates a support shelf on which various items may be placed.

Thus it is an object of the present invention to provide an easy to use tool which supports a weight.

It is a further object of the present invention to provide a tool that is easy to stabilize on a fixed vertical beam.

It is a further object of the present invention to provide a tool that is easy to attach and remove from a fixed beam.

It is yet another object of the present invention to provide a lightweight tool that will support a substantial weight.

It is yet another object of the present invention to provide a tool that will support the weight of a user.

It is a further object of the present invention to provide a tool that will support and provide needed elevation for a user.

Other objects, features, and advantages of the present invention will become apparent upon reading the following detailed description of the embodiments of the invention, when taken in conjunction with the accompanying drawings and the appended claims.

BRIEF DESCRIPTION OF THE DRAWINGS

FIG. 5 is a bottom pictorial view of the tool of FIG. 4.

FIG. 6 is a pictorial view of a tool embodying an alternate embodiment of the present invention.

FIG. 20 is a pictorial view of the tool of FIG. 1 used to create shelving.

FIG. 21 is a pictorial view of the tool of FIG. 1 used to create shelving.

FIG. 22 is a pictorial view of the tool of FIG. 1 used to hang paneling.

DETAILED DESCRIPTION

Figure 1:
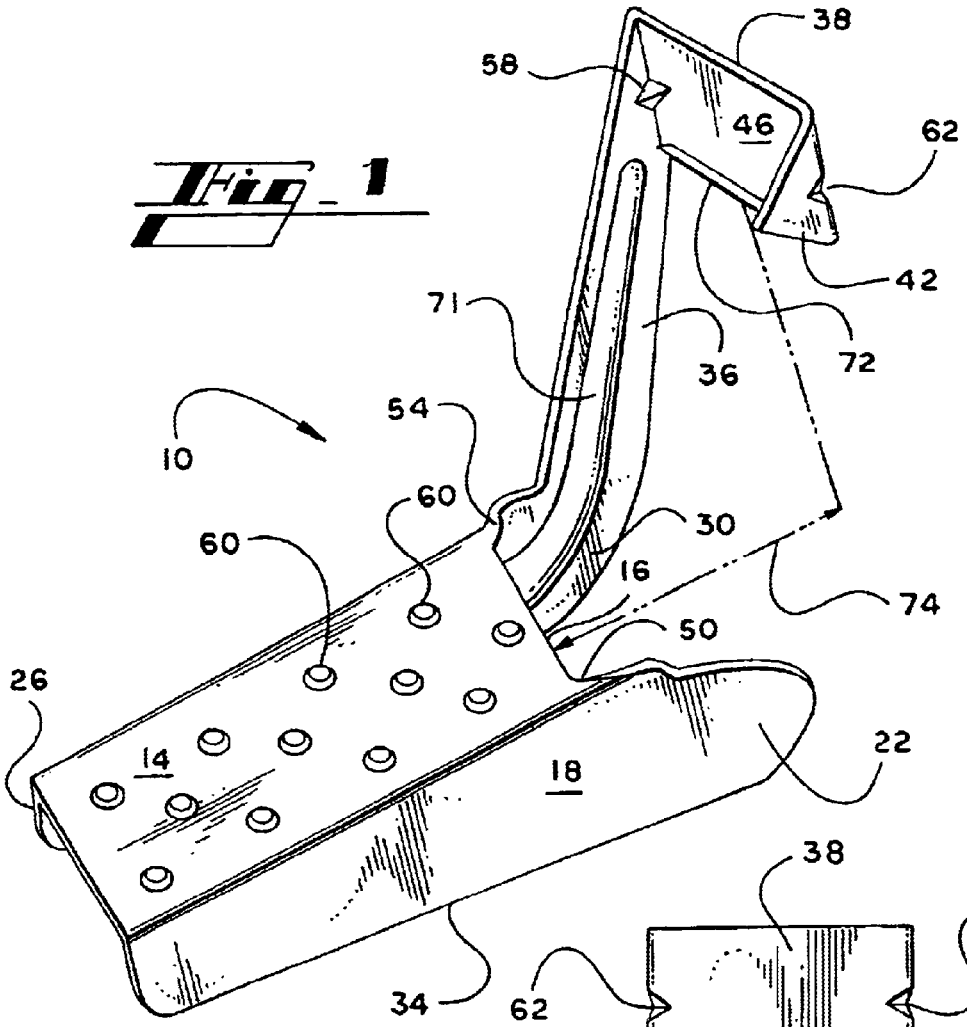
FIG. 1 is a pictorial view of a tool embodying the present invention.

Referring now in more detail to the drawings, in which like numerals refer to like parts throughout the several views, FIG. 1 shows a pictorial view of a tool 10 for attaching to a four-sided wooden structural beam of the type used commonly in construction and supporting a person above the floor. With reference to FIG. 1, the tool 10 has an upper surface 14. The upper surface 14 is substantially rectangular in shape. A first side wall 18 extends vertically downward from a first side edge of the upper surface 14. The side wall 18 extends beyond a rear edge 16 of the upper surface 14, forming a side wall extension 22. A second side wall 26 extends vertically downward from a second side edge of the upper surface 14. A side wall extension 30 extends beyond the rear edge 16 of the upper surface 14. The two side walls 18, 26 are the same dimensions, each having a flat bottom edge 34 upon which the tool 10 can rest when placed on a flat surface. The rear edge 16 of the upper surface 14 is positioned between the two side walls 18, 26. The top edge of the two walls 18, 26, which connect to the two side edges of the upper surface 14, is slightly slanted causing the upper surface to also be slanted.

A vertical member 36 extends upward from the rear extension 30. A collar 38 is connected to the top of the vertical member 36. This allows the collar to engage three sides of the beam when in use. The collar 38 is positioned to be substantially parallel to the rear edge of the upper surface 14. A triangular extension 42 extends from the collar 38, on the opposite side from the vertical member 36. The triangular extension 42 extends towards the upper surface 14 of the tool 10. The collar 38 has a flat, vertical interior surface 46 between the vertical member 36 and the triangular extension 42.

Figure 2:
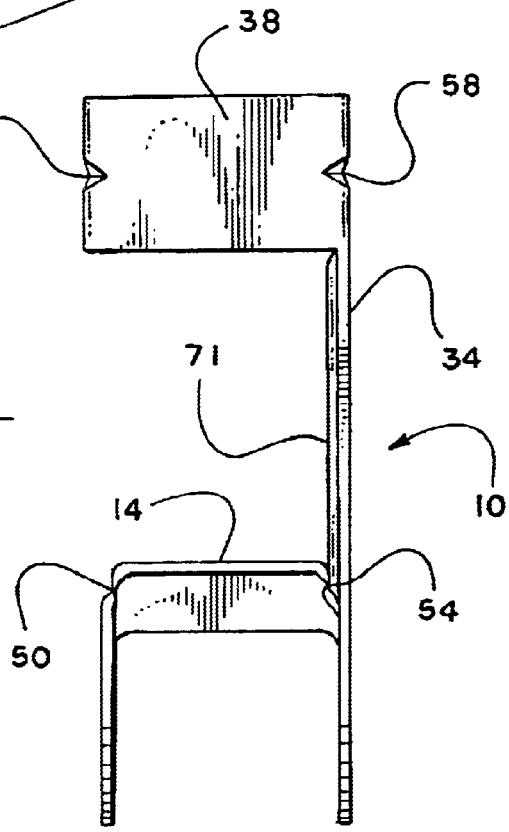
FIG. 2 is an end elevation view of the tool embodying the present invention.

As seen in FIGS. 1 and 2, angled ribs 50, 54 extend between the rear edge 16 of the upper surface 14 and each of the side wall extensions 22, 30. The ribs 50, 54 are tapered slightly to create a sharp exposed surface. An angled rib 58 is located in the corner between the vertical member 36 and the collar 38. Another angled rib 62 is located opposite the angled rib 58, where the collar 38 is connected to the triangular extension 42. The angled ribs 58, 62 are also tapered to create an exposed surface. It should be understood that the angled ribs 58, 62 are optional, however, the tool 10 may be more stable and function better if the ribs 58, 62 are present.

As shown in FIG. 1, several raised circular protrusions 60 are located along the upper surface. Each protrusion is an annular member surrounding a hole in the upper surface. It should be understood that the protrusions could be formed in numerous different shapes.

In the preferred embodiment of the invention, the tool 10 is made of a lightweight metal such as steel. It should be understood that the tool 10 can be made from a variety of other suitable material of sufficient strength. Due to its light weight, approximately 1.1 pounds, the tool 10 can easily be attached to a standard tool belt or pouch used by construction workers.

OPERATION OF THE INVENTION

Figure 3:
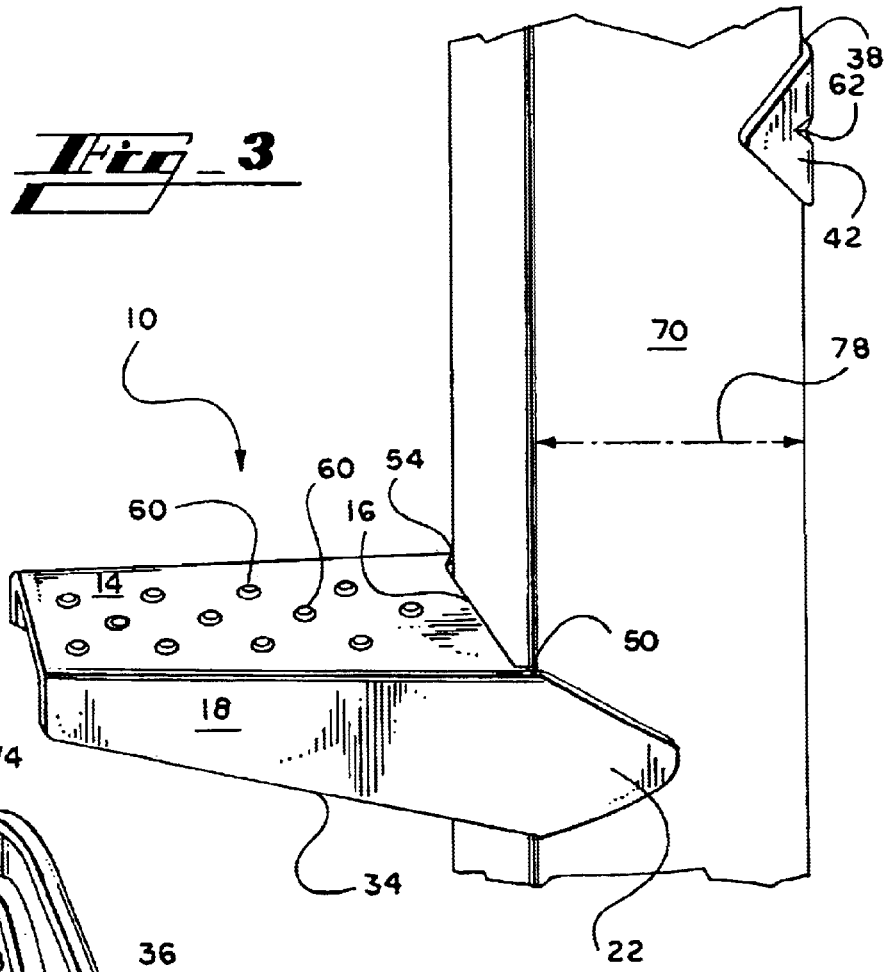
FIG. 3 is a pictorial view of the tool embodying the present invention attached to a wooden beam.

In operation, the tool 10 is typically placed on a four-sided wooden structural beam 70 with the back edge of the upper surface 14 adjacent to a first side of the wooden beam and the collar 38 adjacent to the opposite side of the wooden beam, as shown in FIG. 3. It should be understood that the distance between the first side wall 18 and the second side wall 26 should be slightly larger than the width of the beam 70. Also, the distance 74 between the back edge of the upper surface 14 and the plane in which the collar 38 lies, is slightly larger than the height 78 of the beam 70. It should also be understood that the tool 10 may be used with beams constructed from other materials.

The user must place the tool 10 at a location on the beam 70 corresponding to the appropriate amount of elevation needed. Because the vertical member extends from only one side of the tool, the tool can easily be placed on the beam with only one hand. Once this has been done, the user applies downward force to the upper surface 14. The user may do this initially by hand and then by stepping on the upper surface 14. As pressure is applied to the upper surface 14, the sharp surfaces of ribs 50, 54 engage and grip the first side of the beam 70 by cutting slightly into the beam. The collar 38 then contacts the remaining three sides of the beam 70. This creates a lever. As pressure is applied to the upper surface 14, it is translated through the vertical member 36 to the collar 38. The combination of the ribs 50, 54 engaging the first side of the beam 70 and the collar applying pressure to the remaining three sides of the beam 70 prevents the tool from moving or slipping despite presence of force including torque. A user can safely stand on the upper surface 14 in order to gain the needed support and elevation. The protrusions 60 provide increased friction between the shoe sole of the user and the upper surface 14 of the tool 10, preventing the users foot from slipping off the tool.

The ribs 58, 62 located near the collar 38, also engage the opposite side of the beam 70 as the ribs 50, 54 engage the first side of the beam. This creates increased stability as pressure is applied to the upper surface 14. The ribs 58, 62 also prevent the tool 10 from slipping by improving resistance to twisting moments applied to the tool. The tool 10 actually becomes more stable as the pressure applied to the upper surface 14 is increased.

Figure 19:
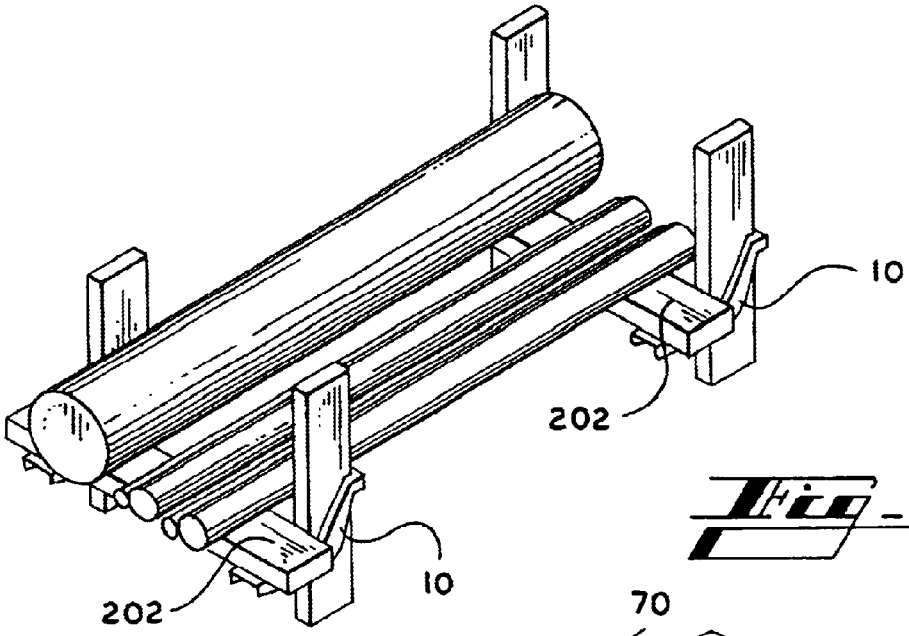
FIG. 19 is a pictorial view of the tool of FIG. 1 used for creating temporary storage.
Figure 18:
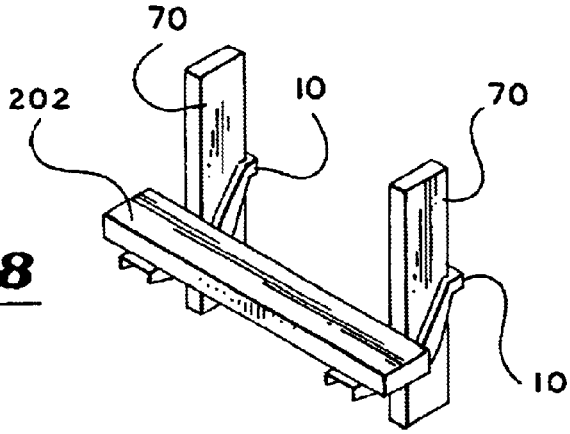
FIG. 18 is a pictorial view of the tool of FIG. 1 used for creating temporary storage.

It should be understood that the tool 10 may be used to perform many different tasks. The tool can be used to create temporary storage in un-finished construction space. As shown in FIG. 18, the tool 10 is placed on a first beam at the desired height. A second tool 10 is placed on a second beam, adjacent the first beam, at the same height. Two additional tools are placed on beams opposite the first and second beam and adjacent to each other at approximately the same height as the first two tools. A plank or beam 202 is placed across the upper surfaces of the adjacent tools. Items, such as ducting, piping or other materials, may be stored by placing the items on the planks supported by the tools as shown in FIG. 19.

The tool can be used to crate shelving in unfinished construction space. As shown in FIG. 20, two tools 10 are placed on adjacent fixed structural beams 70. A wooden plank 206 is placed across the upper surfaces of the two tools. Wood screws 208 are passed through the holes located in the upper structure and from underneath the upper surface. The screws secure the plank to the tools, creating a shelf as shown in FIG. 21.

The tool 10 can be used to accomplish tasks alone which would otherwise require more than one person. For example, the tool 10 can be used when hanging paneling or dry wall 212. A user places a first tool on a beam 70 at a desired height. The user can rest one end of the paneling on the upper surface of the tool, while securing the opposite end. As shown in FIG. 22, the user may place a second tool on a beam located a distance approximately equal to the length of the paneling away from the first tool. The user can then rest the paneling on the two tools and more easily secure the paneling while working alone. It should be understood that the user may use a third tool to engage a beam and provide the user with elevation if the paneling is to be secured at a high location. This allows the user to accomplish such tasks alone, which would otherwise require a second person to hold one end of the paneling while the opposite end is secured. It should be understood that the tool can be used to secure many types of items, particularly large items such as dry wall or molding.

Figure 23:
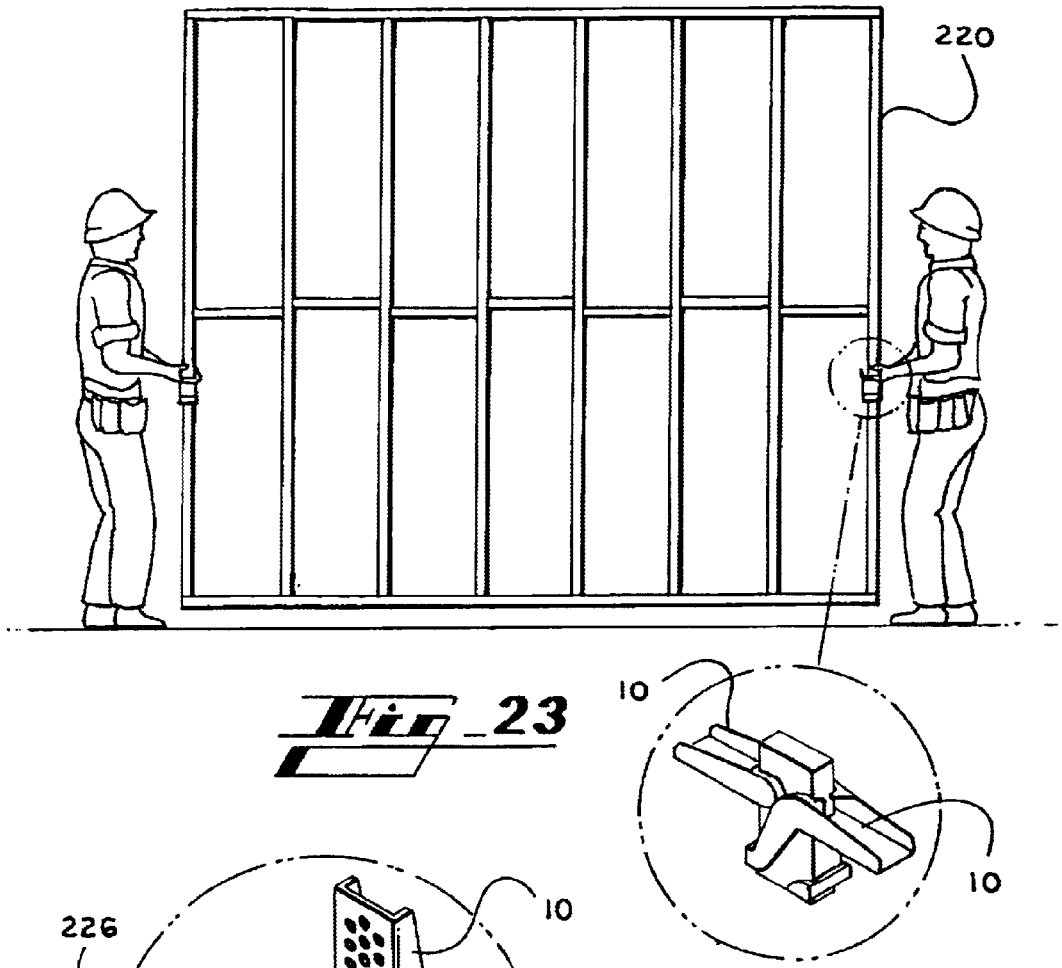
FIG. 23 is a pictorial view of the tool of FIG. 1 used to carry a frame wall panel.

The tool 10 can be used as a tool to carry large items, such as a wall panel. As shown in FIG. 23, the tool can be attached to a frame wall panel 220 and the frame may be lifted using the tool. It may be desirable to attach two tools to the wooden frame in an inverted manner for easier lifting and maneuvering.

Figure 24:
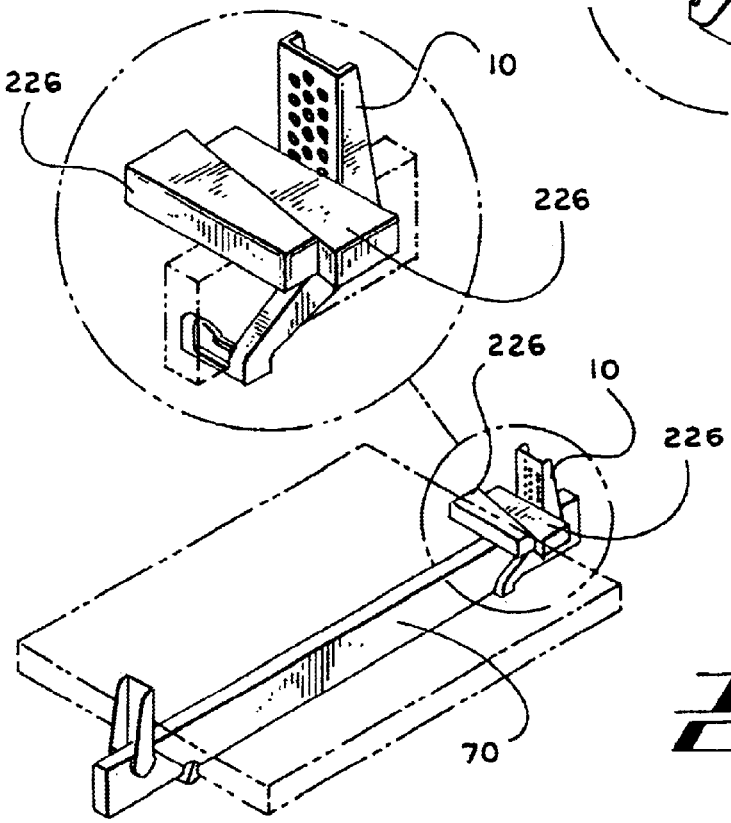
FIG. 24 is a pictorial view of the tool of FIG. 1 used as a clamp.

The tool 10 can be used to create a clamp. As shown in FIG. 24, the tool is placed on a beam 70 adjacent the item to be clamped. Once the tool is secured on the beam, two tapered wedges 226, preferably wooden, can be slid between the upper surface of the tool and the item being clamped. As the tapered blocks are forced together, the gap between the tool and the item is occupied, creating the clamping effect. It should be understood that multiple such clamps may be used to secure an item, depending on the size of the item. For example, two opposing tools may be placed on a single beam to clamp an item between them.

Figure 25:
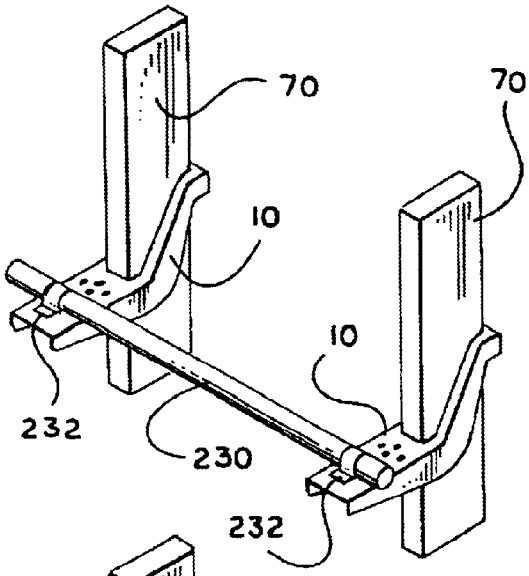
FIG. 25 is a pictorial view of the tool of FIG. 1 used to spread items contained on a spool.
Figure 26:
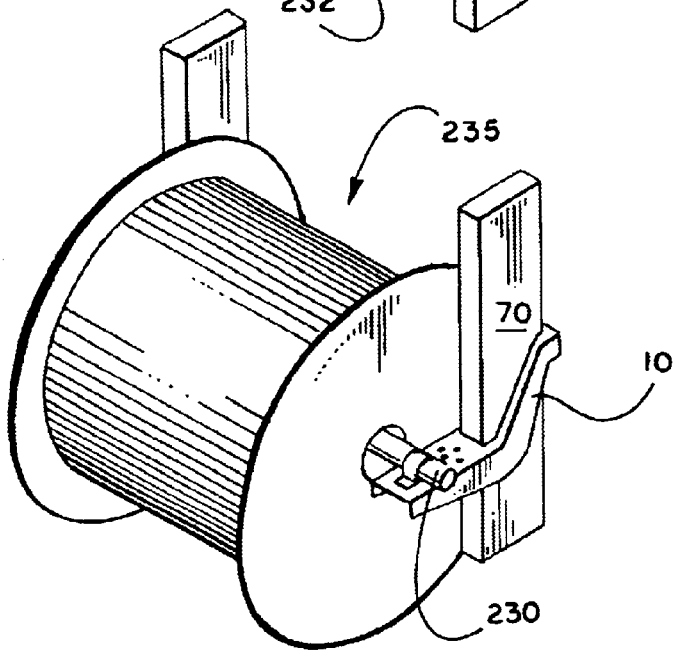
FIG. 26 is a pictorial view of the tool of FIG. 1 used to spread items contained on a spool.

The tool can be used to spread items, such as electrical wiring, insulation, flexible plumbing or other such items stored on an spool. As shown in FIG. 25, two tools are placed on adjacent fixed beams. A rod 230 is passed through the spool 235 and each end of the rod is placed on the upper surface of the tools. The spooled item is located between the tools as shown in FIG. 26. A two hole strap 232, preferably steel, is used to strap the rod to the tools, using bolts (not shown) which pass through the holes of the upper surface. Once the rod is secured to the tools, the spooled item can be easily spread as the spool will rotate on the rod.

Figure 27:
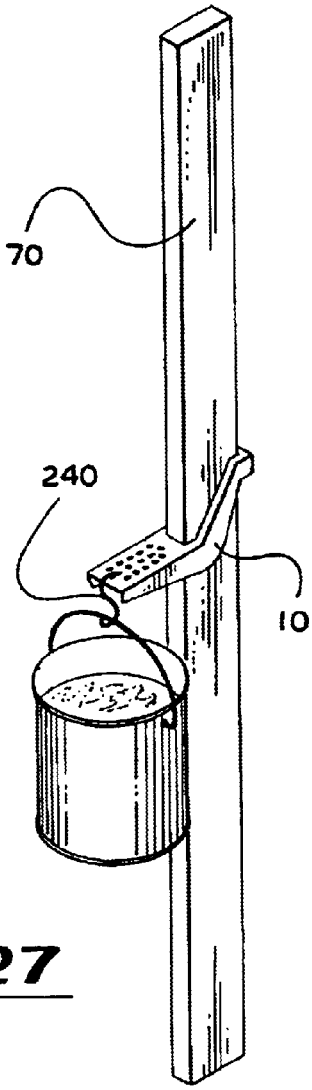
FIG. 27 is a pictorial view of the tool of FIG. 1 used to hang items from a hook.

The tool can also be used as a hanging device as shown in FIG. 27. The tool 10 can be placed on a fixed beam at a desired height and secured. A hook 240 can be placed through the holes of the upper surface for hanging items, such as plants, paint cans or other items from the tool.

ALTERNATE EMBODIMENT OF THE PRESENT INVENTION

Figure 4:
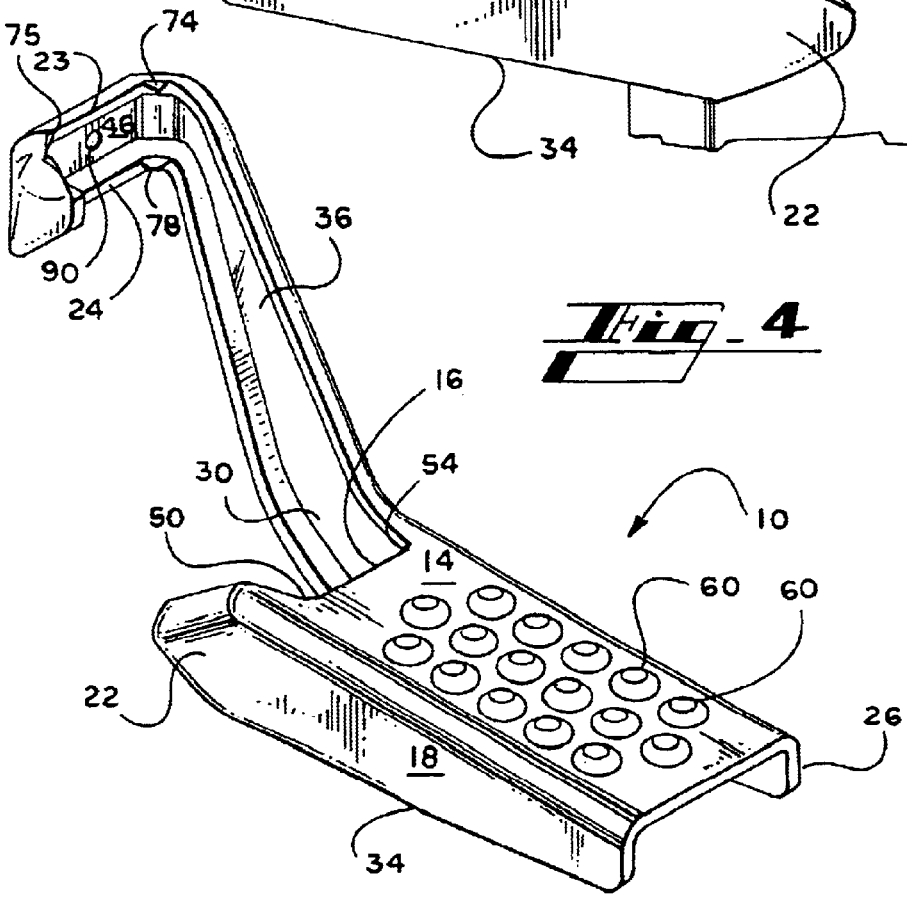
FIG. 4 is a pictorial view of a tool embodying an alternate embodiment of the present invention.
Figure 7:
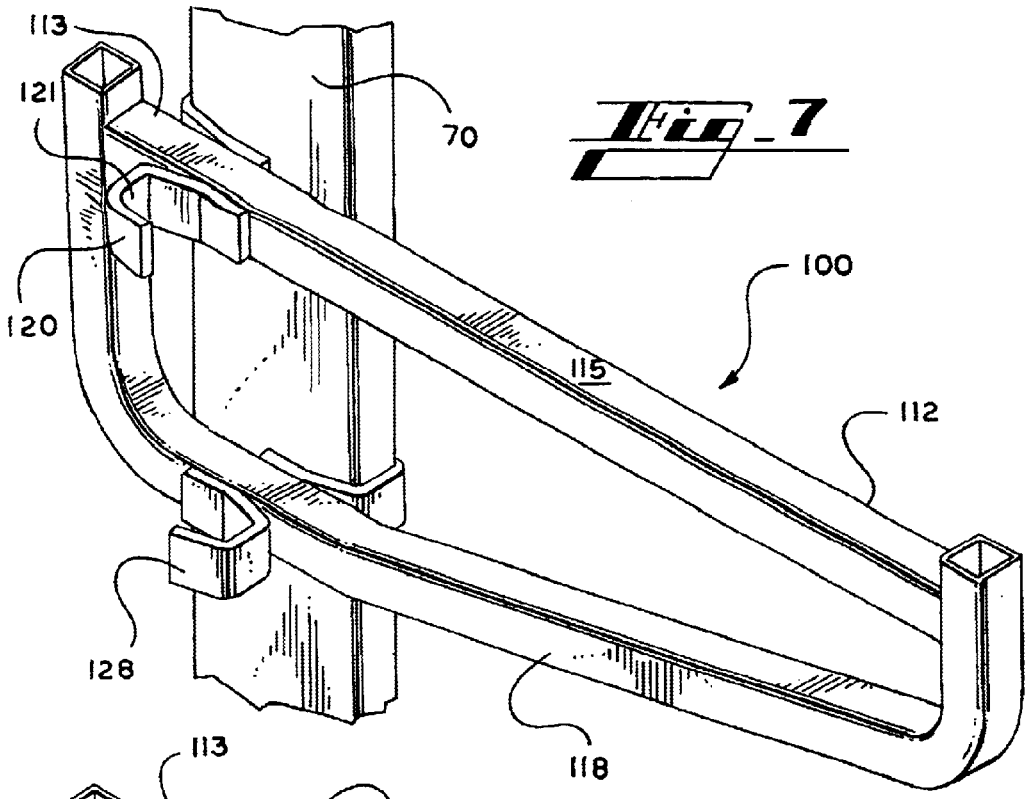
FIG. 7 is a pictorial view of the tool of FIG. 6 attached to a fixed beam.

In another embodiment of the present invention, the vertical member 36 is slightly curved, forming a shallow U shape as shown in FIG. 4. The curvature of the vertical member 36 provides increased strength and stability to the tool 10. The vertical member 36 is better able to resist twisting and bending moments due to forces applied to the tool 10 when in use.

Ribs 74, 75 are positioned in the corners of the top edge 23 of the collar 46. The ribs 74, 75 are tapered slightly to create a sharp exposed surface. Ribs 78, 79 shown in FIGS. 4 and 5, are located in the corners of the bottom edge 24 of the collar 46. The ribs 78, 79 are also tapered slightly to create a sharp exposed surface. When downward force is applied to the upper surface 14, the ribs 74,75,78,79 engage and grip the side of the beam adjacent to the collar 46. In the case of a wooden beam 70, the sharp surfaces of the ribs 74,75, 78,79 cuts slightly into the beam. This action, along with the ribs 50, 54 engaging and gripping the first side of the beam 70, prevents the tool from slipping.

The tool of the present invention may also provide teeth 82, 83 extending from the bottom edge 34 of each of the side walls 18, 26. The teeth 82,83 are positioned to engage the first side of the beam 70. The teeth 82, 83, as shown in FIG. 5, extend inward, toward each other. The teeth 82,83 are located at the rear portion of the side walls, between the side walls 18,26 and the side wall extensions 22,30. This adds further stability to the tool 10 when locked in place and prevents the tool from bending or slipping.

The side wall extensions 22,30 of the present embodiment extend slightly outwardly. This allows the tool 10 to slip more easily over the beam 70 and be locked in place. By providing the slightly outwardly angled side wall extensions 22,30, the side wall extensions act as a guide when placing the tool on a fixed beam. This facilitates centering of the tool 10 with respect to the beam 70. As force is applied to the upper surface 14 of the tool 10, the properly centered tool engages the beam and provides a stable support. The side wall extensions 22,30 may angle outwardly from 2° to 6°.

It should be understood that by providing a single vertical member 36, the tool can easily be placed on and removed from a beam 70 that has fixed ends, by sliding the tool around the beam and locking the tool in place.

As seen in FIGS. 4 and 5, a hole 90 is provided in the center of the collar 46. The hole 90 is provided so that the tool may be hung from a standard display peg. The hole 90 also allows the user to place the tool 10 on a hook or a nail for storage.

It should be understood that the present invention may be used for other applications as well. For example, a pair of tools 10 could be attached to adjacent beams, or studs, in an unfinished construction area. The user attaches the tools 10 at a pre-selected height. For this application, it is preferable that the user place each tool 10 at the same height. A flat surface, such as a board or a plank, can be placed on the upper surface of the tools forming a support shelf. The user may place items on the shelf for storage. It should be understood that the size and, in particular, length of the upper surfaces 14 of the tools 10 may vary in order to accommodate varied sizes of flat surfaces.

Another embodiment of the present invention may be used to form a scaffold. As shown in FIG. 6, the tool 100 comprises an upper support member 112. The upper support member has an elongated flat rectangular upper surface 115 and is either square or rectangular in cross section. A lower support member 118 extends from a first rear end of the upper support member to a second front end of the upper support member. The lower support member is substantially U shaped. The lower support member may also be either rectangular or square in cross section.

A first upper collar 120 is located on the upper support member 112 near the rear end 113 of the upper support member. The first upper collar extends laterally away from the side surface of the upper support member. The first upper collar is positioned such that the inside surface 121 of the collar faces towards the front end 114 of the upper support member. A second upper collar 124 extends laterally away from the side surface of the upper support member and is positioned on the opposite side of the upper support member from the first upper collar. The second upper collar is also positioned near the rear end of the upper support member and is positioned such that the inside surface 125 of the collar faces towards the front end of the upper support member.

A first lower collar 128 is located on the lower support member 118. The first lower collar extends laterally away from the side surface of the lower support member in the same direction as the first upper collar. The first lower collar is positioned such that the inside surface 129 of the collar faces the opposite direction of the inside surface of the first upper collar. The first lower collar is positioned substantially below the first upper collar; the distance between the vertical plane of the inside surface 121 of the first upper collar and the vertical plane of the inside surface 129 of the first lower collar is slightly larger than the height 78 of the beam 70, which may be four inches.

A second lower collar 130 is located on the lower support member 118 and extends laterally away from the side surface of the lower support member in the same direction as the second upper collar. The second lower collar is positioned such that the inside surface 131 of the collar faces the opposite direction of the inside surface of the second upper collar. The second lower collar is positioned substantially below the second upper collar. The distance between the vertical plane of the inside surface 125 of the second upper collar and the vertical plane of the inside surface 131 of the second lower collar is slightly larger than the height 78 of the beam 70, which may be six inches.

Figure 8:
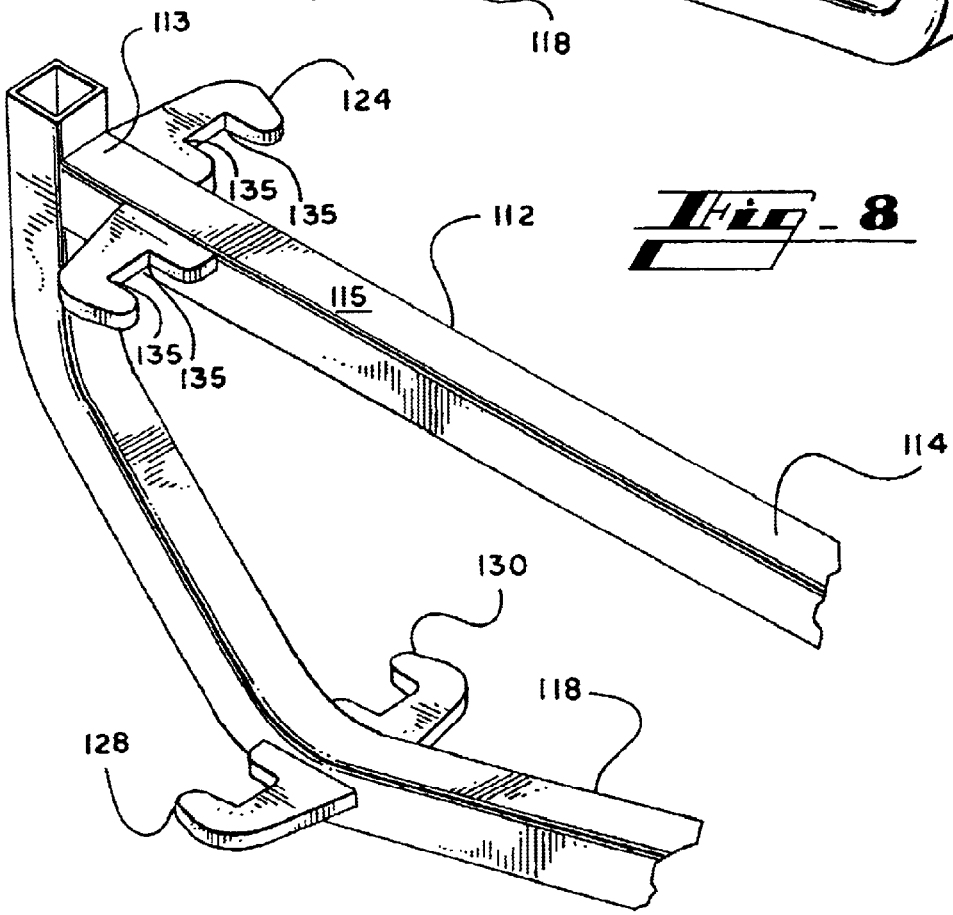
FIG. 8 is a pictorial view of the tool of FIG. 6.

The inside surface of each collar is slightly smaller than the width of the beam 70. The side surfaces of the collars are angled to guide the beam into the collar where it is wedged and locked onto the beam. Ribs 135, as shown in FIGS. 6 and 8, are located in the corners of the inside surfaces 121, 125, 129, 131 of each of the collars 120, 124, 128, 130. The ribs are tapered to create an exposed sharp surface which contacts the beam, further anchoring the tool 100. Depending on the beam height 78, the tool 100 can be attached to the beam using the first upper collar and first lower collar or the second upper collar and second lower collar. For example, if the tool was to be attached to a 2 in.×4 in. beam, the first upper collar and the first lower collar may be used. If the tool was to be attached to a 2 in.×6 in. beam, the second upper collar and second lower collar may be used. It should be understood that the positions of the collars can be varied to accommodate different sized beams. Once the appropriate collars are selected, the tool 100 can be attached to the beam by placing the collars around the beam and applying downward pressure. The ribs 135 cut slightly into the beam and the two collars apply pressure to opposite sides of the beam, preventing the tool from slipping.

Figure 10:
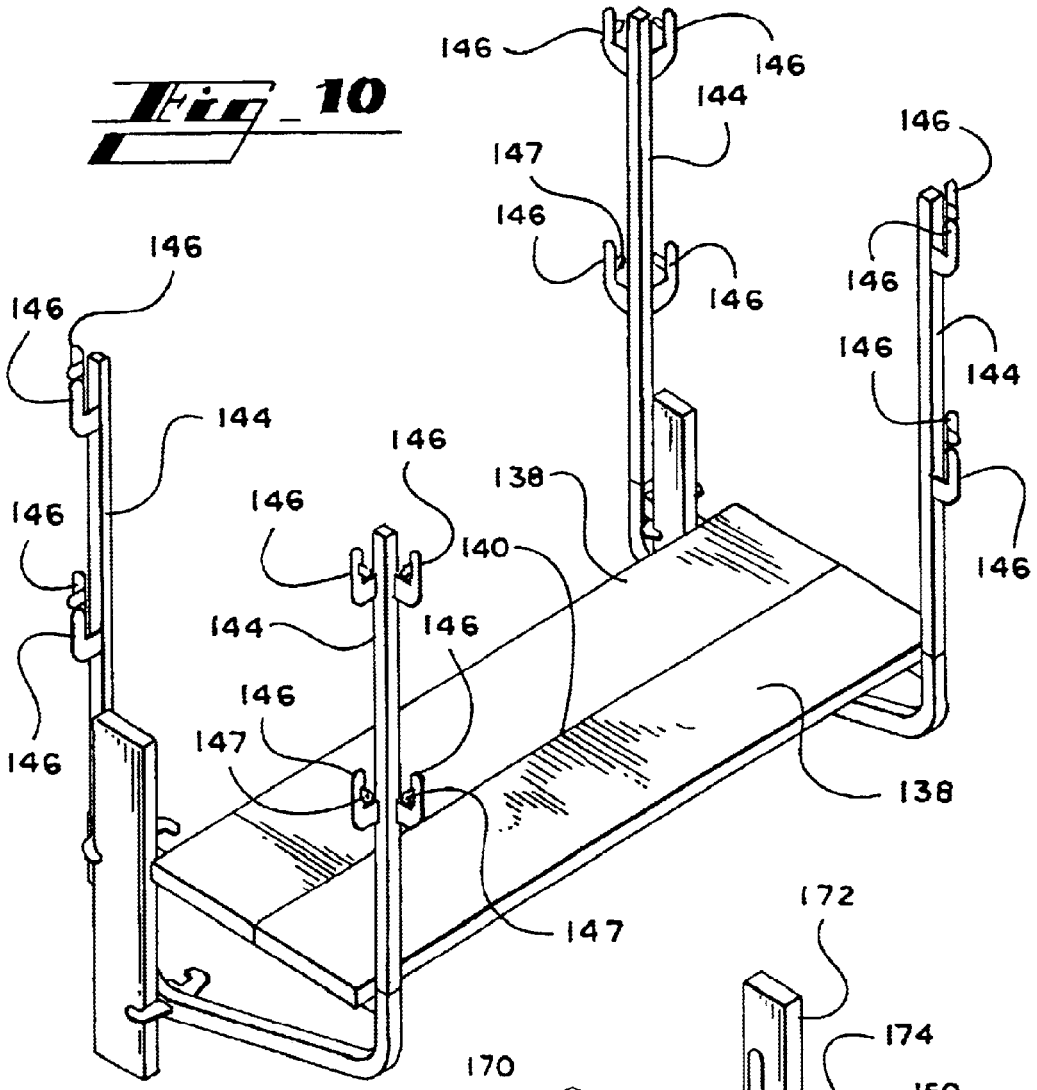
FIG. 10 is a pictorial view of tools of FIG. 6 forming a scaffold.

The present invention can be used to form a scaffold by attaching a first tool 100 to a first beam 70 using the collars. The first tool is locked onto the beam, allowing the ribs to penetrate the beam. A second tool 100 is attached to a second beam, which may be adjacent to the first beam. The second tool is positioned along the second beam at the same height as the first tool and secured using the collars and ribs. Boards 138, which may be 2 in.×12 in., are placed on the upper surface 115 of the upper support member forming a platform 140 for the scaffold, as shown in FIG. 10. The upper support member may be long enough to support two boards, a first board adjacent to the rear end of the upper support member and a second board adjacent the front end of the upper support member. It should be understood that the upper support member may be configured to accommodate a single board or a plurality of boards of different shapes and sizes. A safety block may be attached to the bottom of the boards adjacent to the upper support member, to further secure the boards forming the platform.

Figure 9:
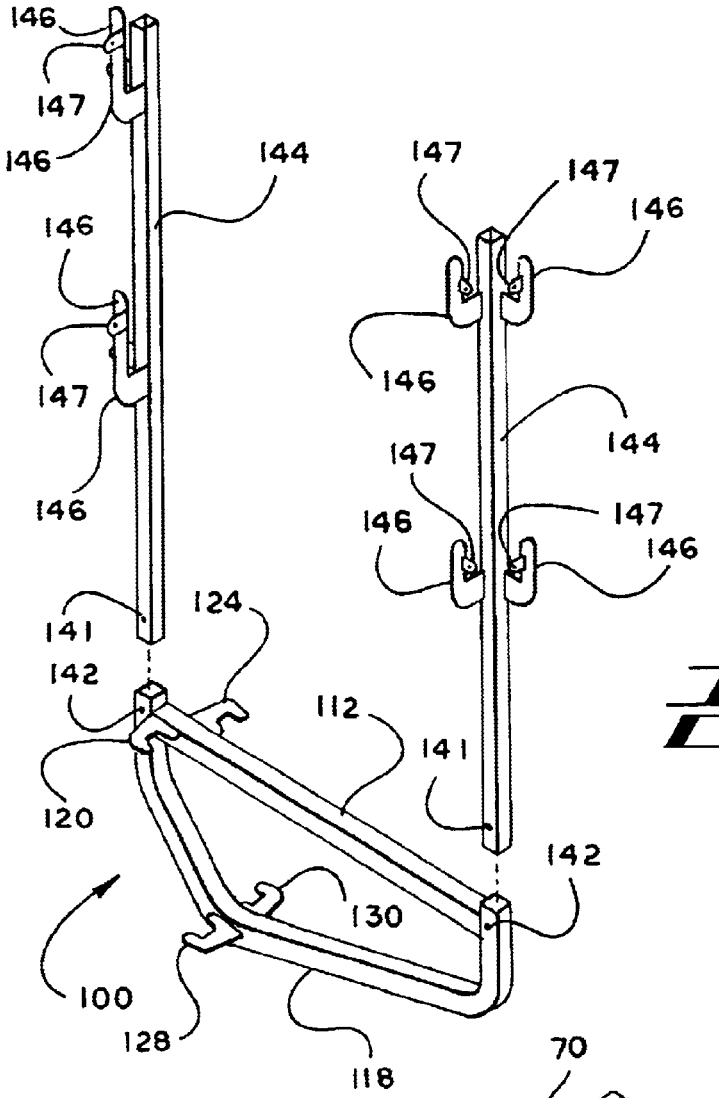
FIG. 9 is a pictorial view of the tool of FIG. 6 with vertical members.

In order to add further stability to the scaffold, vertical support members 144 can be attached to the lower support member, as shown in FIG. 9. Each end of the lower support members has openings. The openings are positioned to accept a vertical support member, which may be of slightly smaller cross section than the lower support member. The vertical support member can be inserted into the ends of the lower support member, and extend vertically from the platform. A small hole 141 may be located on each end of the lower support member. A similar sized hole 142 located on the vertical support members can be used to position the vertical support member within the lower support member. Once the holes 141, 142 are aligned, a pin 143, such as a spring loaded pin, may be inserted into the aligned holes to lock the vertical support member in place. Thus, two vertical support members may be attached to the first tool and two vertical support members may be attached to the second tool, as shown in FIG. 10.

Figure 11:
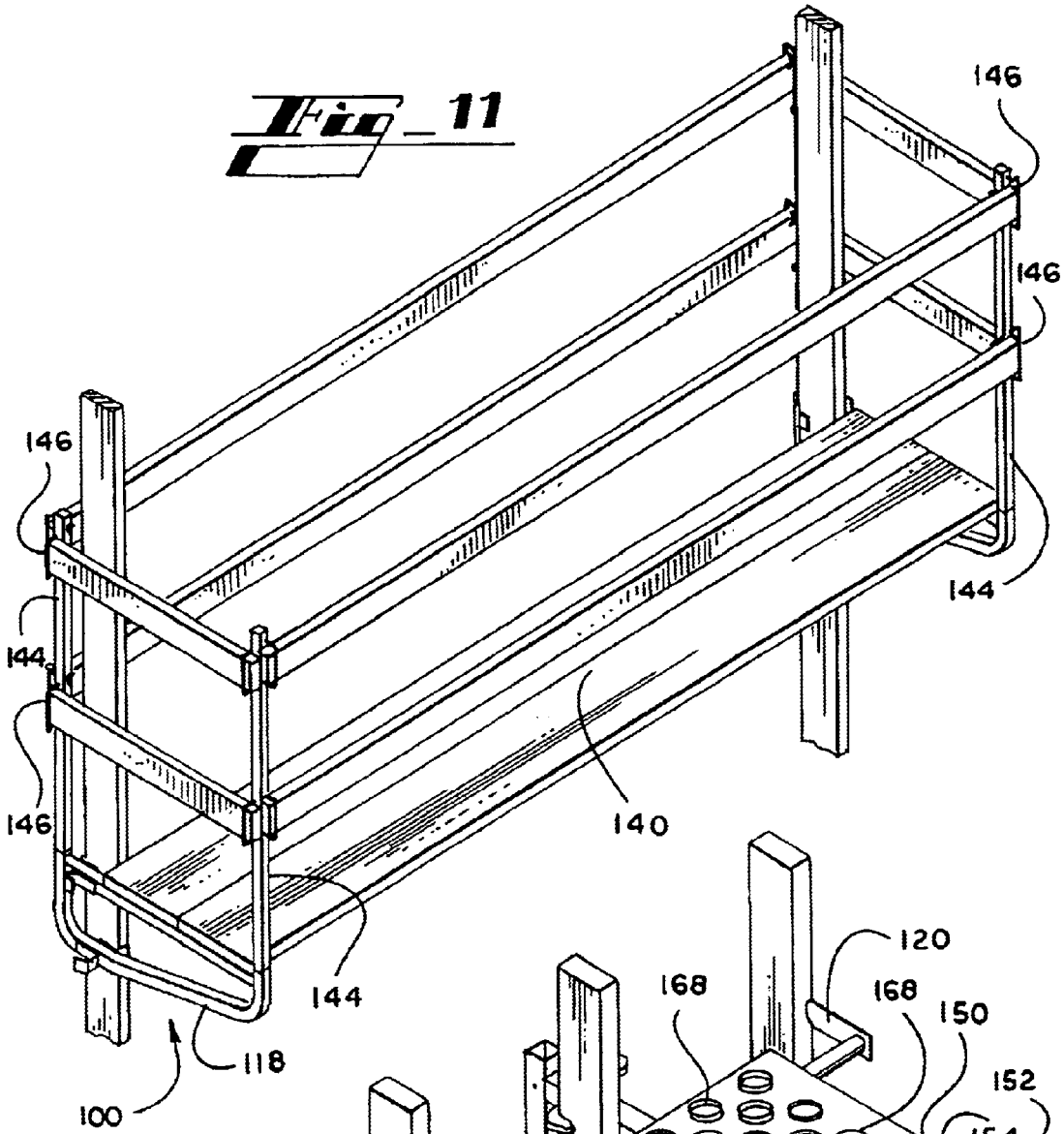
FIG. 11 is a pictorial view of tools of FIG. 6 forming a scaffold.
Figure 15:
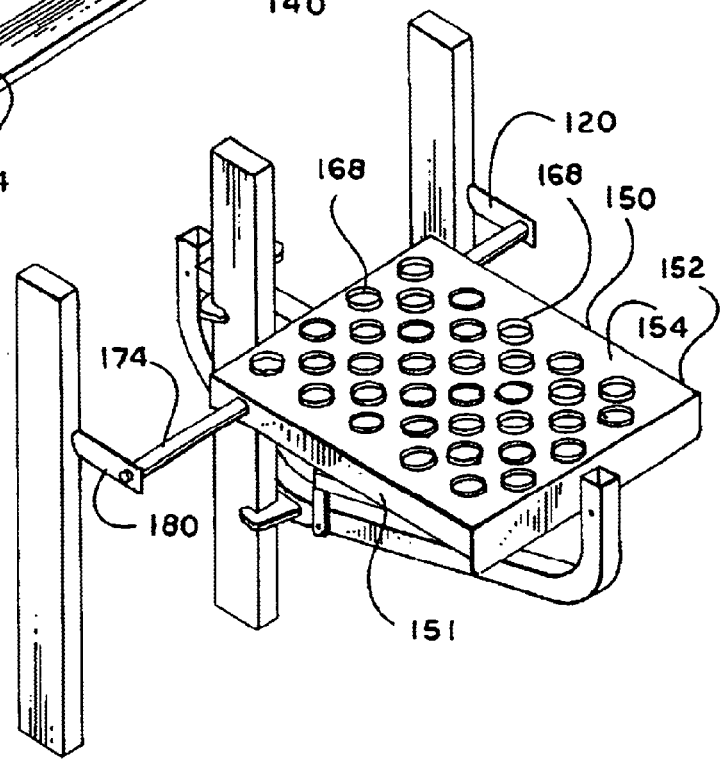
FIG. 15 is a pictorial view of the tool of FIG. 6 and a platform accessory.

Brackets 146 extend outwardly from each of the vertical support members. Two brackets are located at approximately the midpoint, on adjacent sides of the vertical member. Two additional brackets are located near the top, on adjacent sides of the vertical member. When the four vertical members are positioned in the tools forming the scaffold, the brackets of the vertical members are horizontally aligned. As shown in FIG. 11, beams can be placed on horizontally aligned brackets forming a handrail. It should be understood that beams of appropriate size and length are placed between brackets on adjacent vertical members. This provides increased stability for a user standing on the scaffold.

Each bracket may have a small tab 147 extending laterally from the bracket. The tab abuts the beam placed in the bracket and has a hole in the center. A screw can be passed through each hole and into each beam, further securing the beams to the brackets and vertical support members. The brackets are preferably L shaped brackets, but it should be understood that C shaped brackets and other shaped brackets may be appropriate.

Figure 12:
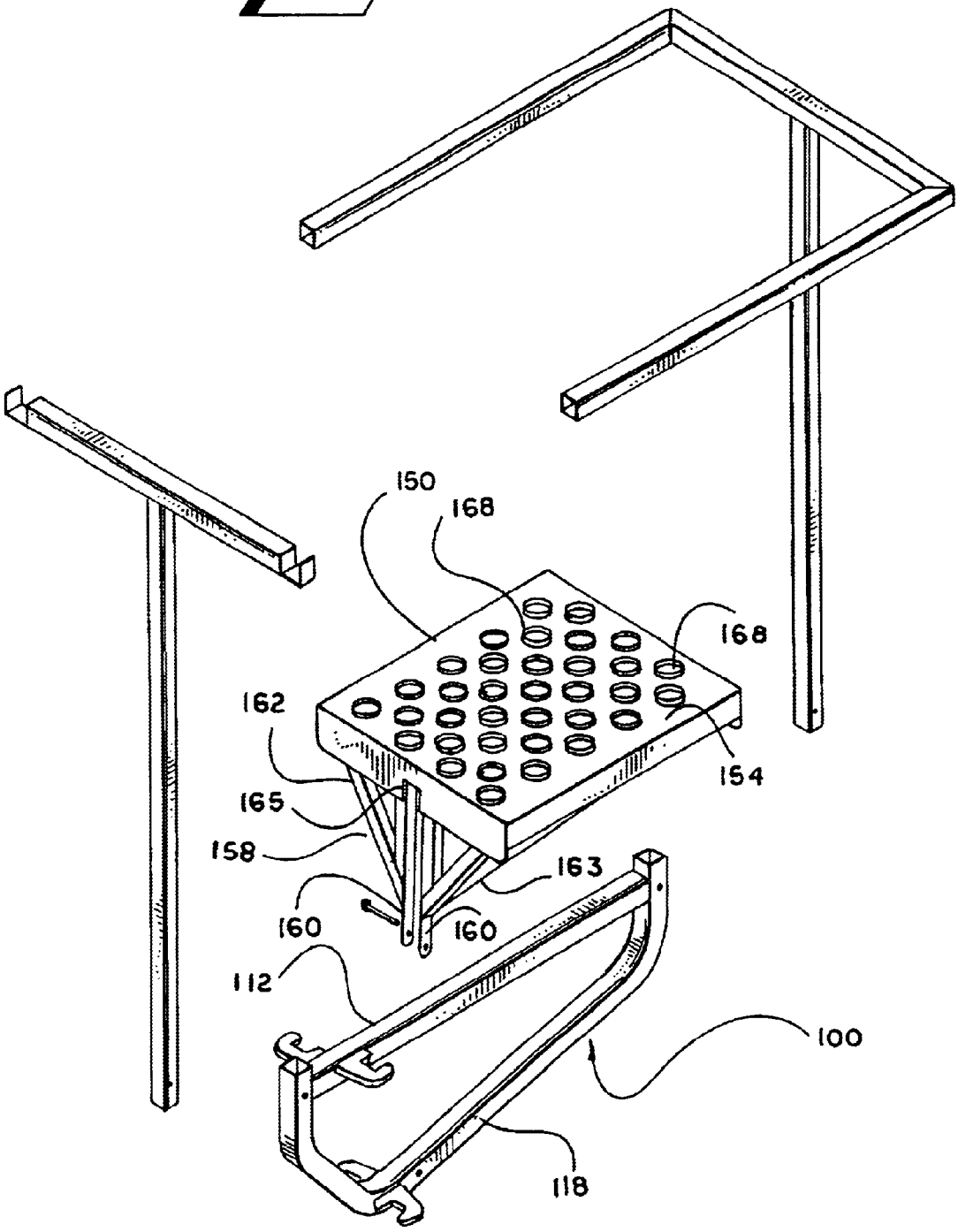
FIG. 12 is a pictorial view of the tool of FIG. 6 and a platform accessory.

The present invention may also be used with a platform accessory 150 to form a platform as shown in FIG. 12. The platform accessory comprises a horizontal surface or platform 154 with a support assembly 158 underneath. The support assembly provides two elongated support struts 160 that extend downward from the bottom side of the platform. The support struts are attached to opposite sides of the lower support member 118. The support struts may be attached using a screw that passes through both support struts and the lower support member and is secured by a nut. The support assembly also provides two angular support struts 162, 163 extending from the lower portion of each support strut to the corners of the bottom side of the platform 154. This provides additional support for the platform. A rectangular notch 165 located in the center of the front and rear walls of the platform allows the platform accessory to sit on the upper support member. Raised circular protrusions 168 on the platform surface provide increased friction for a user standing on the platform, preventing slipping. Thus, a user using the present tool with the platform accessory can form a convenient platform simply by locking the tool on a fixed beam and attaching the platform accessory to the tool.

Figure 13:
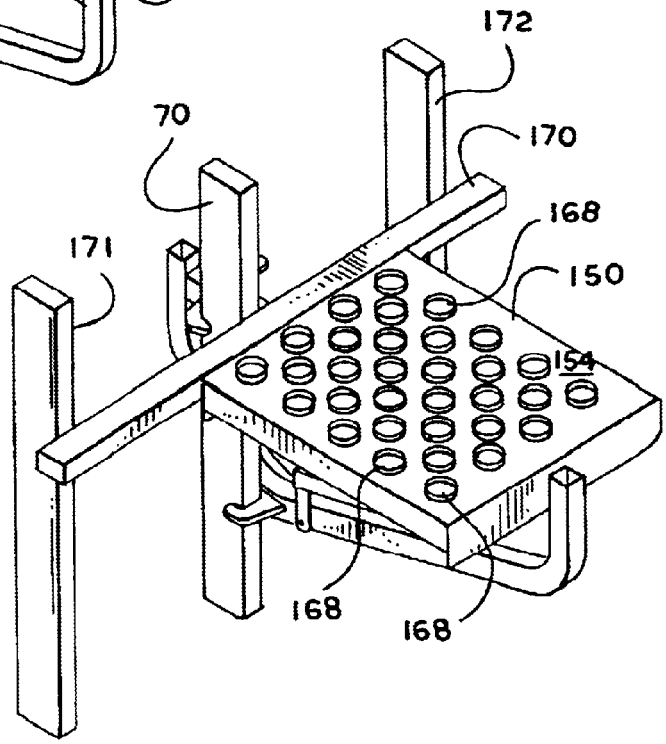
FIG. 13 is a pictorial view of the tool of FIG. 6 and a platform accessory.
Figure 14:
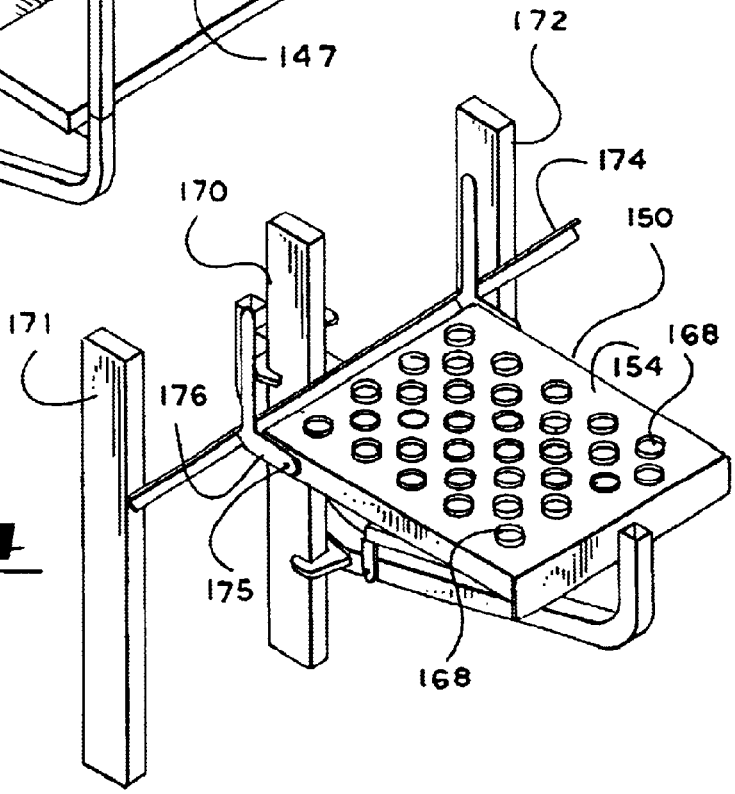
FIG. 14 is a pictorial view of the tool of FIG. 6 and a platform accessory.
Figure 17:
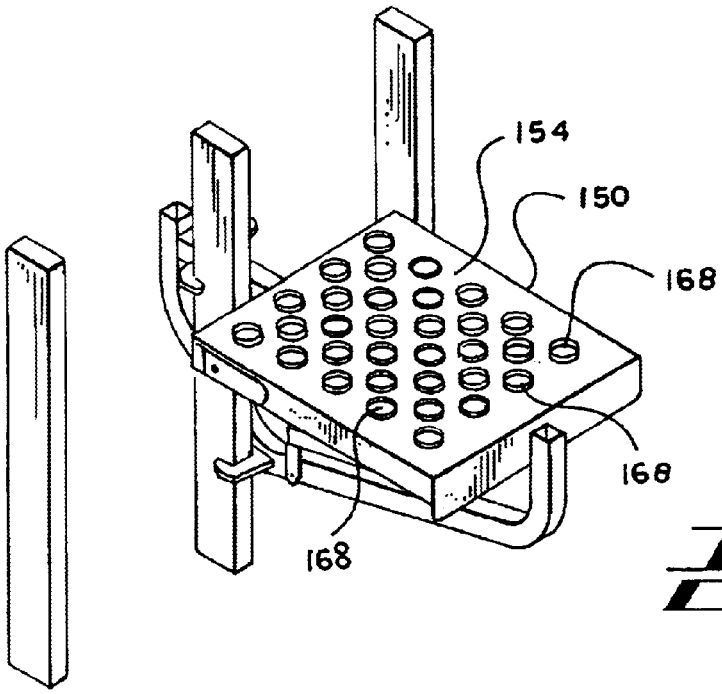
FIG. 17 is a pictorial view of the tool of FIG. 6 and a platform accessory.

As shown in FIG. 13, the tool and platform accessory can be further stabilized by placing a beam 170, such as 2 in.×4 in. beam, horizontally between the rear wall of the platform 154 and the fixed beam 70 to which the tool 100 is attached. The beam 170 preferably extends horizontally in both directions beyond the fixed beams 171, 172 immediately adjacent to the fixed beam 70. This adds further stability to the platform and prevents the platform from twist around the fixed beam 70. Alternatively, the platform accessory may provide a stabilizer bar 174. The stabilizing bar, as shown in FIG. 14 can be connected to the side walls of the platform 154 using a hinge 175 and hinge arms 176 that are attached to the stabilizer bar. This allows the stabilizer bar to be retracted for easy attachment and removal of the platform accessory. Once rotated downward, the stabilizer bar provides stability to the platform in the same manner as the above described horizontal beam 170. The stabilizer bar is preferably long enough to extend horizontally beyond at least the two fixed beams 171, 172 immediately adjacent to fixed beam 70. Alternatively, the stabilizer bar 174 may be positioned to pass through the side walls 151, 152 of the platform 154. The stabilizer bar can be extended or retracted laterally. In the retracted position, the stabilizer bar is roughly the same size as the width of the platform as shown in FIG. 17. Once extended, the stabilizer bar extends laterally from the side walls of the platform in opposite directions so that the ends of the stabilizer bar are aligned with the fixed beams 171, 172 immediately adjacent to the fixed beam 70. The stabilizer bar can be rotated such that stabilizer extensions 180 attached to each end of the stabilizer bar engage the fixed beams 171, 172. The rotation of the stabilizer bar is preferably accomplished using a cam assembly attached to the stabilizer bar.

Figure 16:
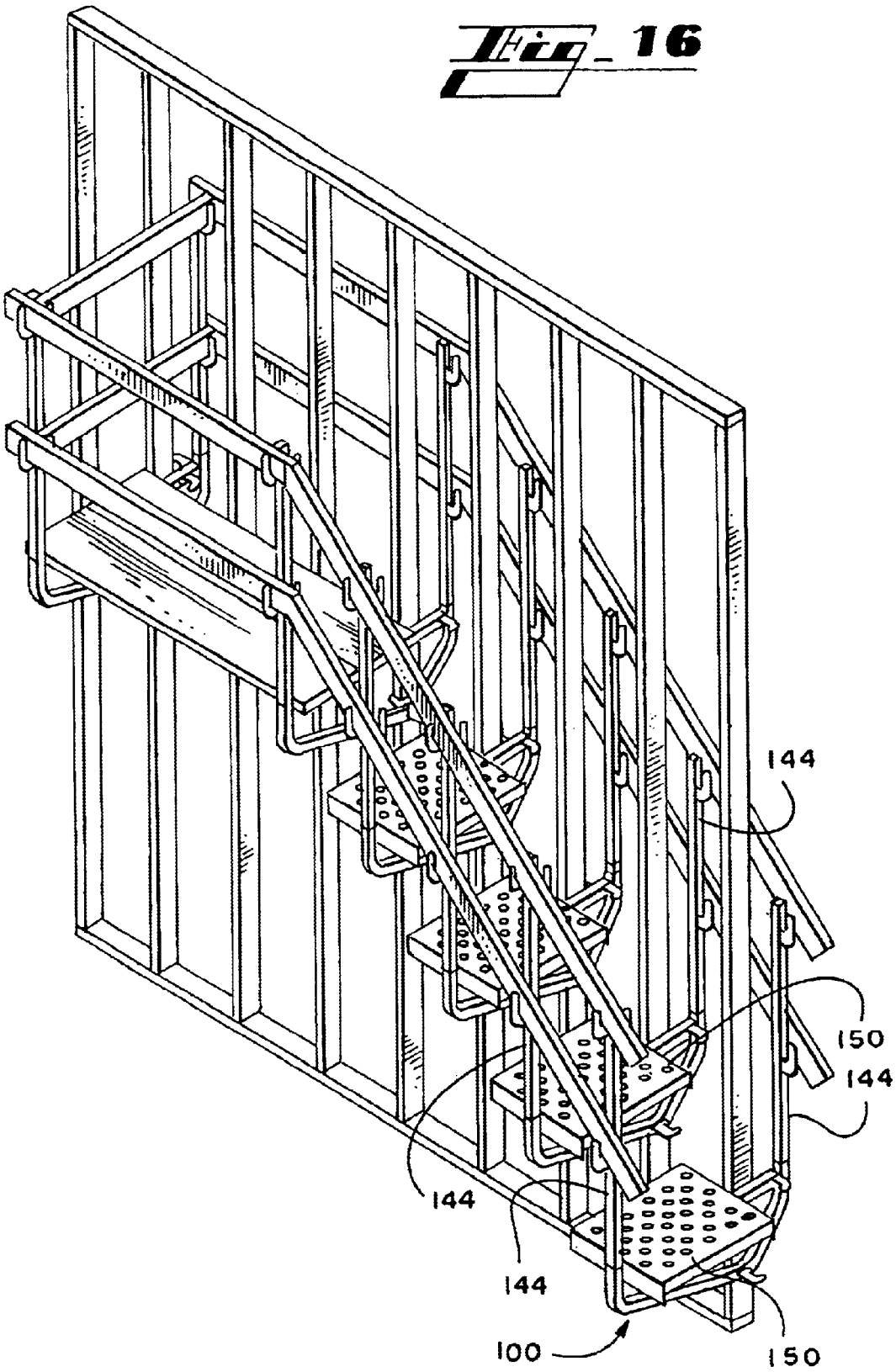
FIG. 16 is a pictorial view of tools of FIG. 6 and platform accessories forming a staircase.

The present invention can be used with the platform accessory 150 to form a type of staircase as shown in FIG. 16. The tools 100 are locked to successive fixed beams 70 at successively increasing height. The platform accessories 150 attached to each tool in the above described manner form the stairs. The user can use this combination of the present invention to gain access to a platform, also provided by the present invention, which may be too elevated to otherwise access. Vertical members 144 attached to each tool 100 of the staircase can be used to form a handrail for the staircase. Beams are secured to the brackets 146 of the vertical members as previously described to form the handrail.

While the invention has been described in detail with particular reference to preferred embodiments thereof, it will be understood that modifications and variations may be made without departing from the scope of the invention as defined in the appended claims.

I claim:

1. A tool for engaging a four-sided rectangular wooden structural beam of the type used in construction, the tool comprising:

an upper surface for supporting a person using the tool to provide elevation;

first ribs extending from a rear edge of the upper surface for engaging and gripping a first side of a beam;

at least one vertical member extending from only one side of the rear edge of the upper surface of the tool, the opposite side of the rear edge being open allowing a user to engage the tool to a beam using only one hand;

side walls extending downwardly from the side edges of the upper surface and side wall extensions extending beyond the rear edge of the upper surface, the side wall extensions angled slightly outwardly facilitating centering of the tool on a beam;

a collar connected to the vertical member for engaging the remaining three sides of a beam; and second ribs extending from the collar and gripping a beam, whereby the first ribs, the vertical member, the collar, the side wall extensions and the second ribs allow the tool to engage all four sides of a beam and resist torque when force is applied to the upper surface such as the weight of a person standing on the upper surface using the tool for elevation.

2. The tool of claim 1 wherein the second ribs extend from the top corners of the collar.

3. The tool of claim 1 further comprising protrusions located on the upper surface.

4. The tool of claim 1 wherein the tool weighs less than 1.5 pounds allowing a user to engage the tool to a beam using one hand.

5. The tool of claim 1 further comprising a hole in the collar for hanging the tool from a hook.

6. The tool of claim 1 wherein the vertical member is U-shaped providing increased resistance to torque when force is applied to the upper surface.

7. A method of using a tool for engaging a four-sided wooden substantially vertical fixed structural beam of the type used in construction for supporting the weight of a person using the tool to provide elevation comprising:

placing the tool at a selected height along a beam using a single hand, the tool comprising an upper surface, first ribs extending from a rear edge of the upper surface for gripping a beam, at least one vertical member extending from only one side of the rear edge of the upper surface, the opposite side of the rear edge being open, side walls extending downwardly from the side edges of the upper surface and side wall extensions extending beyond the rear edge of the upper surface, a collar connected to the vertical member for engaging the remaining three sides of a beam and second ribs extending from the collar;

applying a downward force to the tool by stepping on the upper surface of the tool, wherein the first ribs are caused to grip the first side of a beam and the collar and the second ribs are adapted to engage the remaining three sides of a beam allowing a person to stand on the tool and achieve the desired elevation, whereby the tool capable of engaging all four sides of a beam contributes resistance to torque applied to the tool and resistance to slipping of the tool from a beam.

8. The method according to claim 7 wherein the side wall extensions are angled slightly outwardly facilitating centering of the tool on a beam.

9. The method according to claim 7 wherein the upper surface comprises raised protrusions to prevent slipping on the upper surface of the tool.

10. A shelving unit for storing items in unfinished construction space comprising:

a first and second tool, each tool engaging a four-sided rectangular wooden beam of the type used in construction, each tool comprising;

an upper surface for supporting a person using the tool to provide elevation;

first ribs extending from a rear edge of the upper surface for engaging and gripping a first side of the beam;

at least one vertical member extending from only one side of the rear edge of the upper surface of the tool, the opposite side of the rear edge being open allowing a user to engage the tool to the beam using only one hand;

side walls extending downwardly from the side edges of the upper surface and side wall extensions extending beyond the rear edge of the upper surface; and a collar connected to the vertical member for engaging the remaining three sides of the beam and second ribs extending from the collar and gripping the beam;

whereby the first ribs, the vertical member, the side wall extensions, the collar and the second ribs allow the tool to engage all four sides of the beam and resist torque when force is applied to the upper surface such as the weight of a person standing on the upper surface using the tool for elevation; and a plank placed on the upper surface of the tools creating a shelf for storage of items.

11. The shelving unit of claim 10, wherein the plank is secured to the tools by screws.

* * * * *